US006360976B1

(12) United States Patent
Pallmann

(10) Patent No.: US 6,360,976 B1
(45) Date of Patent: Mar. 26, 2002

(54) ELEMENT OF A DRUM-SHAPED PULVERIZING APPARATUS

(75) Inventor: Wilhelm Pallmann, Zweibrücken (DE)

(73) Assignee: Pallmann Maschinenfabrik GmbH & Co. KG, Zweibruücken (DE)

( * ) Notice: Subject to any disclaimer, the term of this patent is extended or adjusted under 35 U.S.C. 154(b) by 0 days.

(21) Appl. No.: 09/461,541

(22) Filed: Dec. 15, 1999

(30) Foreign Application Priority Data

Dec. 18, 1998 (DE) ..... 298 22 550 U

(51) Int. Cl.[7] ..... B02C 17/22
(52) U.S. Cl. ..... 241/299
(58) Field of Search ..... 241/299, 188.1, 241/189.1, 182, 183

(56) References Cited

U.S. PATENT DOCUMENTS 3,966,126 A * 6/1976 Werner ..... 241/188.1

FOREIGN PATENT DOCUMENTS

EP 0978317 * 7/1999

* cited by examiner

*Primary Examiner*—Mark Rosenbaum
(74) *Attorney, Agent, or Firm*—Friedrich Kueffner

(57) ABSTRACT

Element in a drum-shaped pulverizing apparatus having a rotating impact wheel system. The element has an alternating arrangement of sections with and without shaping ridges, and the sections with shaping ridges include recesses disposed between adjacent shaping ridges. The shaping ridges of at least one shaped section are aligned with either the shaping ridges of an adjacent shaped section and the recesses between shaping ridges of an adjacent shaped section.

18 Claims, 2 Drawing Sheets

ELEMENT OF A DRUM-SHAPED PULVERIZING APPARATUS

BACKGROUND OF THE INVENTION

1. Field of the Invention

The invention relates to an element of a drum-shaped pulverizing apparatus, for example, for use in a gas-throughflow pulverizing machine with a rotating impact wheel system having an alternating arrangement of sections, with and without shaping, in the rotational direction, whereby the shaping is comprised of shaping ridges oriented adjacent one another, with recesses lying between the shaping ridges, and the shaping ridges are sloped at an angle oppositely with respect to the symmetry axis that is oriented in the direction of rotation.

2. Background of the Invention

Elements of the type described above are especially known in connection with grinding containers. These elements, in their circumferential alignment with respect to one another, form the surface of the grinding container on which the coarse feed material is transformed into fine material. The desired degree of fineness for the fine material is determined, in this connection, by the envisioned range of application of the fine material.

The degree of fineness depends on several factors such as, for example, the distance of the impact wheel from the surface of the grinding container or the cross-sectional makeup of the shaping arrangement, especially as regards the length of time that the coarse material is held in the grinding container. The holding time encompasses the elapsed time from the initial introduction of the coarse material into the grinding container until the grinding container is emptied.

The holding time can be influenced by predetermined measures relating to the impact wheel, as discussed, for example, in DE 198 35 144 A1. The holding time can also be controlled, however, by the manner in which the shaping arrangement is oriented on the surface of the grinding container. For this purpose, it is known to orient the shaping ridges in the form of a "V" with respect to the grinding apparatus surface. Consequently, a short or long holding time (of the feed material in the grinding container) prevail, depending on whether the shaping ridges are open or closed in the circumferential direction of the impact wheel.

An objective in connection with pulverizing coarse material is always to obtain a maximal amount of optimally sorted fine material. In other words, the variation in the degree of fineness, both in size and shape, is to be kept as low as possible.

In known apparatus, individual sections with a shaped surface are positioned one after the other in the circumferential direction of the impact wheel, with the interposition of non-shaped sections. In this connection, the influence borne by shaping a given section, in connection with the shaping of a subsequent section, on the flow of material inside the pulverizing apparatus, warrants no consideration. In this manner, it is possible to observe in existing pulverizing apparatus that neither the shaping ridges nor the recesses (of a given section or of an element having a similar section) lying therebetween will align. In other words, between the shaping arrangements of two neighboring sections or elements a more or less starkly defined shift exists via which, during operation of such a pulverizing machine, the holding times of the coarse material in the grinding container will fluctuate much too an excessively. A portion of the coarse material will quickly progress through the shaped sections of the grinding container in a straight shot so that the result will be fine material with coarse grains. Another portion, when progressing through, will hit the grinding surfaces at the rear side of the shaping ridges of the subsequent shaped section and will then always be stopped and turned back so that, because of the long holding time that results, some fine material of reduced diameter will be produced.

The great range of variation, in the size and shape of fine material product, caused by the above will reduce the quality of the fine material and, in some cases, will necessitate a further sifting of the fine material.

SUMMARY OF THE INVENTION

In the context discussed above, the object of the invention is to control the degree of fineness of the fine material via the type of shaping arrangement employed by the elements in the pulverizing apparatus and, at the same time, to produce, in abundance, optimally sorted fine material.

In accordance with the invention, this object is achieved by way of an element having the following features: the shaping ridges of a shaped section are aligned either with the shaping ridges, or the recesses between shaping ridges of a subsequent shaped section.

Advantageous modifications are set forth throughout the instant disclosure.

A fundamental concept of the present invention is to bring the individual shaped sections, of a pulverizing apparatus that is configured to achieve a given result, into association with one another and to harmonize them with one another. In this connection, the goal is to create to most uniform flow ratios as far as the material flow in the grinding container is concerned, that is, the passage of the coarse material within the grinding container will not overcome contingencies but will, by way of constructive measures, be predeterminable.

In this connection, control of the holding time of the coarse material within the pulverizing apparatus can be achieved as well as control of the degree of fineness. Moreover, the result will be optimally sorted fine material that is also qualitatively of great value and that can be used for further processing without first being finishprocessed.

By way of an advantageous embodiment, the length of the element side disposed at the circumference of the pulverizing apparatus is equivalent to 1/10 to 1/30 the circumference of the pulverizing apparatus. With the largest possible elements, the number of elements provided in a complete pulverizing apparatus will be as small as possible, with the result that the time expenditure associated with the installation and removal of the individual elements will be minimal. For a given size of the elements, they must (in terms of their cross-section) be able to accommodate to the curve of the pulverizing apparatus. Otherwise, an effective pulverization of the coarse material cannot be guaranteed, on account of deviations from the rotational track of the impact wheel.

According to another advantageous embodiment of the invention, the lengths of the sides of the shaped sections disposed at the circumference of the pulverizing apparatus vary in the range from 20 to 30 mm. With smaller dimensions for the sections, the quantity of sections will correspondingly increase. With a shifted alignment of the shaping arrangement with respect to a subsequent section, the result is a frequent stoppage and deflection of the material flow as in the case of large elements so that, in this manner, the holding time of the coarse material can be increased considerably. At the same time, the number of edges extending transversely with respect to the direction of rotation, and that define the borders of the sections, will also be increased. These edges undertake a significant portion of the pulverizing activity so that, with an increase in the number of edges, the efficiency of the pulverizing apparatus will also ultimately increase.

Further, it is advantageous to provide more shaped sections, inclusive of non-shaped sections disposed therebetween, on an element. In this connection, the desired orientation and harmonization of the shaping arrangement, with respect to sections disposed one after the other, is easily achieved and thus no longer constitutes any source of error when the elements are mounted. As far as large elements are concerned, it is also the case that expenditures relating to installation are reduced.

Further advantages are realized with the shaping ridges being oriented at an angle that is 25° to 45° with respect to the symmetry axis (of the elements) oriented in the direction of rotation. With an acute angle of impact of the coarse material on the shaping ridges, the impact energy, and the associated abrasion on the element, is reduced. In addition, because of the greater length of the shaping ridges, the result is a longer holding time of the coarse material within the grinding container, which leads to a higher degree of fineness.

A further advantageous embodiment is provided when the width of the shaping ridges is greater than that of the recesses between the shaping ridges. With a shifted orientation of the shaping arrangement, it is thus guaranteed that the entire quantity of coarse material will be stopped and deflected between two shaped sections.

As discussed herebelow, further constructive measures are contemplated in connection with suitably shaped surfaces of an element according to the invention, whereby the desired degree of fineness can be achieved.

BRIEF DESCRIPTION OF THE DRAWINGS

The invention will now be better explained with relation to an exemplary embodiment illustrated in the drawings, wherein.

DESCRIPTION OF THE PREFERRED EMBODIMENTS

Figure 1:
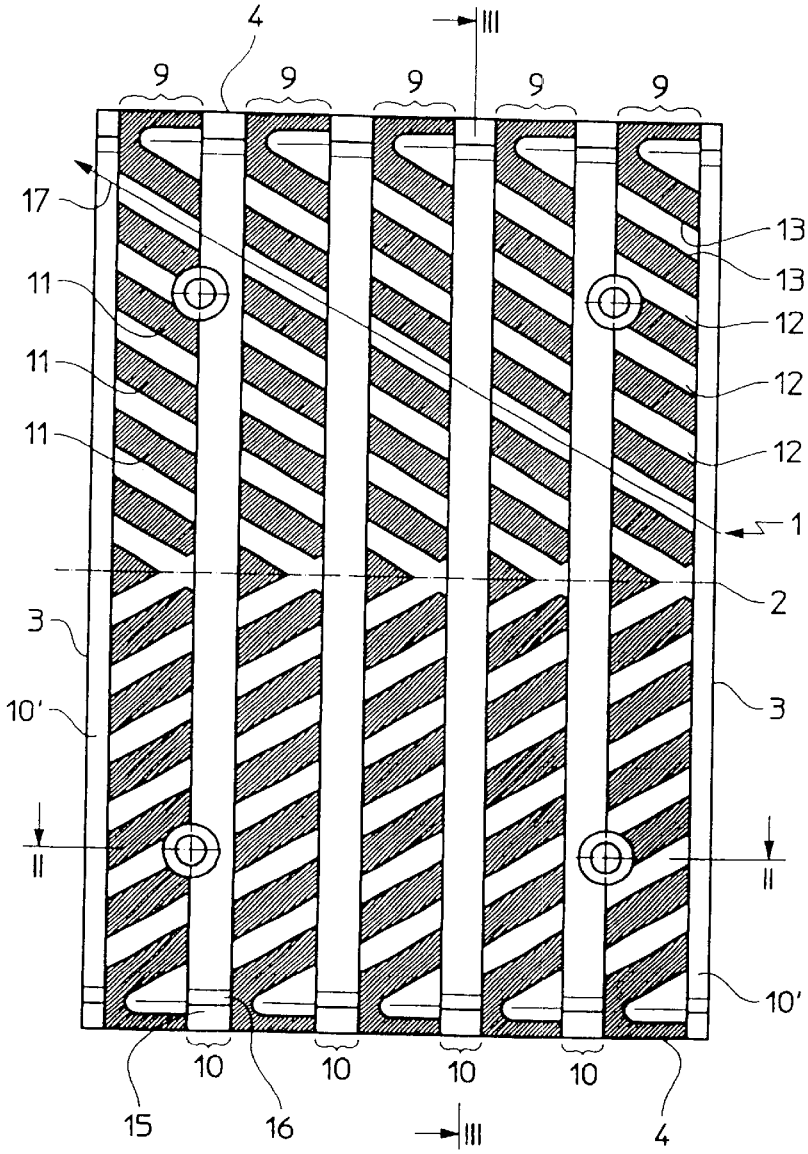
FIG. 1 shows an elevational view of an element according to the invention.

FIG. 1 shows an element 1 of a grinding container in a twin-flow mill. Essentially, element 1 is rectangular in shape and is formed symmetrically with respect to symmetry axis 2. The longer sides 3 of element 1 constitute the connection points on which, at any given time, a number of similar elements 1 are assembled together in a drum-shaped grinding apparatus. The shorter sides 4 of element 1 border a rim throughout the entire circumference of the grinding container.

Figure 3:
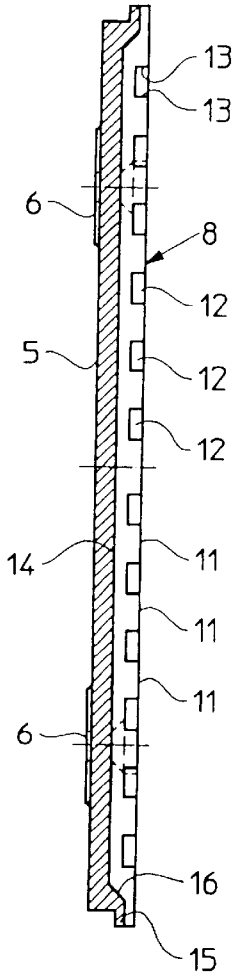
FIG. 3 shows a longitudinal cut-away view of the element illustrated in FIG. 1, taken along the line III—III
Figure 2:
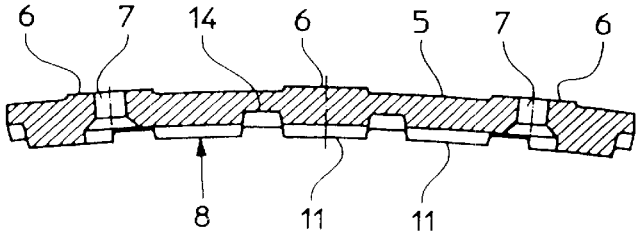
FIG. 2 shows a cross-sectional view of the element illustrated in FIG. 1, taken along the line II—II.

In order to enable the most precise track for the rotating impact wheel in a twin-flow mill, element 1 is, with respect to its cross-section, curved (FIG. 2), whereby the curvature of element 1 corresponds to the curvature of the grinding container. The element 1, which is adapted for attachment to a mounting ring that is a secondary structure, includes for this purpose, as shown in FIGS. 2 and 3, rectangular surfaces 6 that gently protrude from the underside 5. In the vicinity of the outermost protruding surfaces, there are apertures through element 1 through which sunken-head screws are introduced for attaching the elements to a mounting ring.

The surface of element 1 constitutes the active side of the grinding apparatus. The surface 8 is formed from five sections 9 with shaping and from four sections 10 without shaping disposed therebetween. The sections 9 and 10 extend parallel to the longer sides 3, and transversely with respect to the symmetry axis 2, throughout the entire element 1.

As can be seen in FIGS. 1 and 3, the shaped sections 9 include a number of shaping ridges 11 that are straight and are in parallel with respect to one another. Cross-sectionally, the shaping ridges 11 are rectangular and form a gradient of 30° with respect to symmetry axis 2. Only along the short sides 4 do the shaping ridges deviate from this orientation, at which point they are parallel to the short sides 4. Between the shaping ridges 11, there are rectangular recesses 12, in which the coarse material is transported along sides 13. The cross-sectional width of the recesses 12 is somewhat smaller than that of the shaping ridges 11.

The shaped sections 9 are separated from the non-shaped sections 10. The non-shaped sections 10 basically are comprised of a groove whose bottom 14 lies deeper than in the case of the recesses 12 so that, as a result, a sufficient volume is created in order to carry off to the side, with the assistance of an air stream, sufficiently refined material. In order to prevent the removal of material that has not yet been sufficiently pulverized, the non-shaped sections 10 include, at both of their ends, a sealing ledge 15 that is bound to a short side 4 and that is connected to groove bottom 14 by way of a slope 16. The top of the ledge 15 lies underneath the surface of the shaping ridges 11, so that, on the one hand, material that is only slightly pulverized will be held back at slope 16 and, on the other hand, the fine material can already be removed off by way of the ledge 15. In order to accommodate a suitable connection of the grinding container to a sifting surface (not shown) provided at both sides, the ledge 15 surmounts rear side of the element 1.

The non-shaped sections 10' disposed at long sides 3 have only half of the width of a non-shaped section 10 but are otherwise formed similarly to a section 10. When two elements 1 are installed together, then the result in the region of connection will be a shaped section corresponding to the non-shaped section 10.

The sections 9 that follow one after the other (separated by non-shaped sections 10) are positioned with respect to each other in such a way that not only the shaping ridges 11 but also the recesses 12 are completely in alignment. In this manner, a straight-line flow of material (as indicated by arrow 17) is enabled in which the material to be pulverized can be directed away from the grinding container region relatively quickly. This type of shaping arrangement for element 1 is suitable, above all, for producing coarse-grained fine material.

Figure 4:
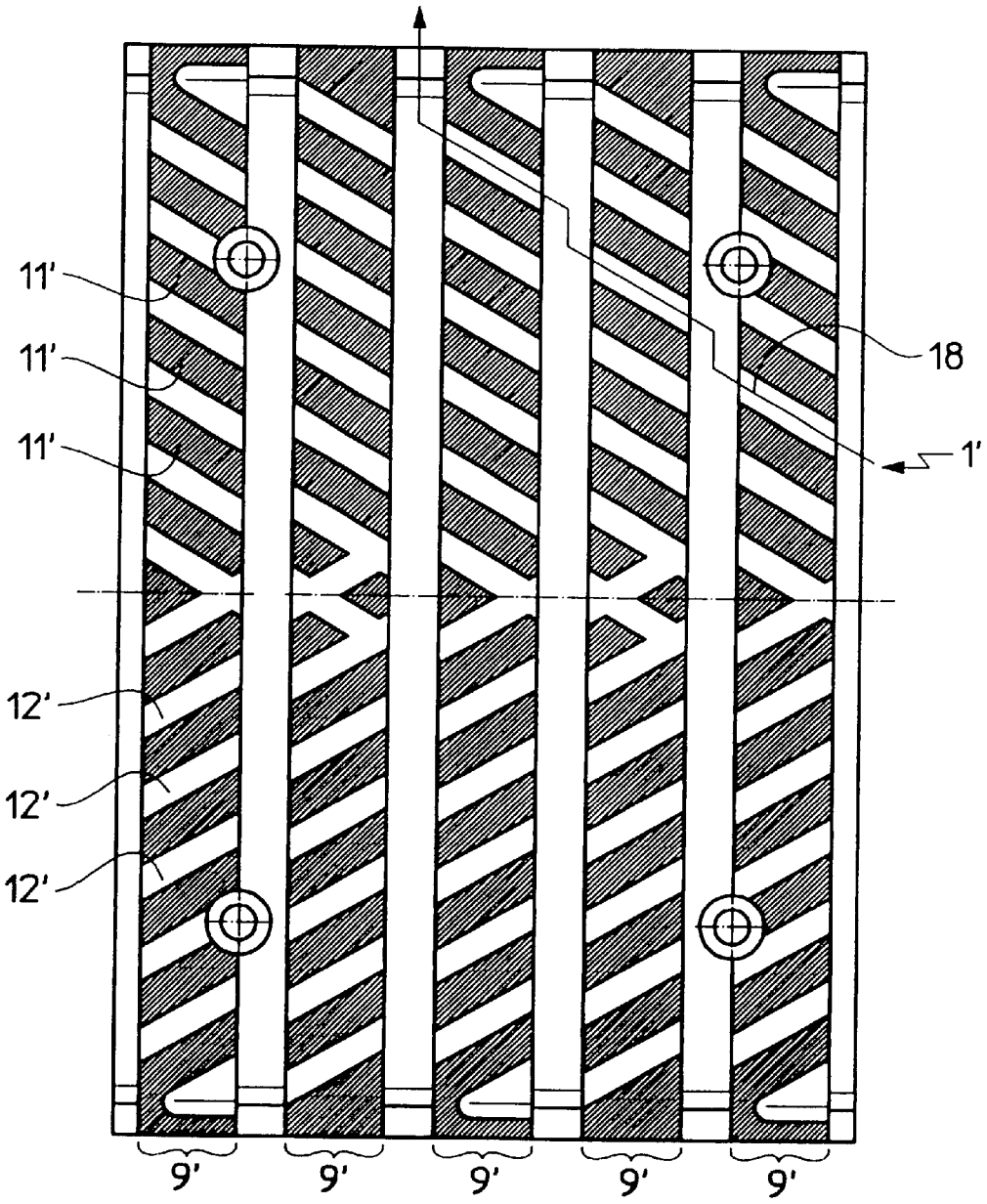
FIG. 4 shows a plan view of another element according to the invention.

In FIG. 4 another embodiment of an element (1') according to the invention is shown. The construction of element 1' corresponds, for the most part, to that of element 1. The only difference is the orientation of the ripple ridges 11' of the shaping arrangement and the recesses 12' disposed therebetween. In order to retard the material flow and thus to increase the holding time within the grinding container of the material to be pulverized, the impedance and deflection of the material flow is carried out abundantly with the assistance of the shaping arrangement shown in FIG. 4. For this purpose, the shaping ridges 11' and recesses 12' of a shaped section 9' are shifted with respect to the shaping ridges 11' and recesses 12' of a subsequent shaped section 9' so that any material progressing through a recess 12' will contact the rear side of a shaping ridge 11' of a subsequent shaped section 9' There, it will be stopped, deflected back, stopped again and then finally will be deflected into the recess 12' of the subsequent shaped section 9'. This process is symbolized by arrow 18 and applies to every shaped section 9'. With the assistance of elements 1' configured in this manner, the product will be optimally sorted fine material of reduced diameter.

While specific embodiments of the invention have been shown and described in detail to illustrate the inventive principles, it will be understood that the invention may be embodied otherwise without departing from such principles.

Any patents, patent publications or other publications cited or mentioned herein are hereby fully incorporated by reference as if set forth in their entirety herein.

What is claimed is:

1. Element adapted to be mounted in a drum-shaped pulverizing apparatus having a rotating impact wheel system rotating in a direction of rotation, said element comprising:

an alternating arrangement of sections with parallel shaping ridges and sections without shaping ridges;

said sections with shaping ridges comprising groove-shaped recesses disposed between adjacent shaping ridges;

said shaping ridges being oriented at an angle with respect to a symmetry axis that is parallel to the direction of rotation;

said sections with parallel shaping ridges having edges adjacent said groove-shaped recesses, said shaping ridges and said groove-shaped recesses extending over an entire width of said section between said edges; and wherein said shaping ridges of at least one section are aligned with one of the following (A) and (B):

(A) said shaping ridges of an adjacent section with shaped ridges; and (B) said groove-shaped recesses between shaping ridges of an adjacent section with shaped ridges.

2. Element according to claim 1, wherein said element comprises a transverse side being disposed at the circumference of the pulverizing apparatus and in parallel to the direction of rotation of said pulverizing apparatus, the length of said side being between about 1/10 and about 1/30 of the circumference of the pulverizing apparatus.

3. Element according to claim 2, wherein said element has a curvature corresponding to that of the pulverizing apparatus.

4. Element according to claim 3, wherein said shaped sections have a transverse side disposed at the circumference of the pulverizing apparatus, said transverse side having a length of between about 20 and about 30 mm.

5. Element according to claim 4, wherein said transverse side of said shaped sections has a length of about 25 mm.

6. Element according to claim 4, wherein characterized in that said non-shaped sections have a transverse side disposed at the circumference of the pulverizing apparatus, said transverse side of said non-shaped sections having a length of between about 7.5 mm and about 17.5 mm.

7. Element according to claim 6, wherein said transverse side of said non-shaped sections has a length of about 12.5 mm.

8. Element according to claim 6, wherein the ratio between the length of the transverse side of said element and the length of one of said shaped sections is between about 1/5 and about 1/25.

9. Element according to claim 8, wherein said ratio is between about 1/10 and about 1/15.

10. Element according to claim 8, wherein three to five shaped sections are disposed on said element.

11. Element according to claim 10, wherein said angle is between about 25° and about 45°.

12. Element according to claim 11, wherein said angle is about 30°.

13. Element according to claim 11, wherein said shaping ridges have a greater cross-sectional width than said recesses disposed between said shaping ridges.

14. Element according to claim 13, wherein said cross-sectional width of said shaping ridges is between about 7.5 and about 12.5 mm.

15. Element according to claim 14, wherein said cross-sectional width of said shaping ridges is about 10 mm.

16. Element according to claim 14, wherein the width of said recesses disposed between said shaping ridges is between about 5 and about 10.5 mm.

17. Element according to claim 16, wherein the width of said recesses disposed between said shaping ridges is about 8 mm.

18. An element in combination with a drum-shaped pulverizing apparatus having a rotating impact wheel system, said element being disposed in a grinding container of said apparatus, said element comprising:

an alternating arrangement of sections with parallel shaping ridges and sections without shaping ridges;

said sections with shaping ridges comprising groove-shaped recesses disposed between adjacent shaping ridges;

said shaping ridges being oriented at an angle with respect to a symmetry axis that is parallel to the direction of rotation;

said sections with parallel shaping ridges having edges adjacent said groove-shaped recesses, said shaping ridges and said groove-shaped recesses extending over an entire width of said section between said edges; and wherein said shaping ridges of at least one section are aligned with one of the following (A) and (B):

(A) said shaping ridges of an adjacent section with shaped ridges; and (B) said groove-shaped recesses between shaping ridges of an adjacent section with shaped ridges.

* * * * *